United States Patent [19]

Tanaka

[11] Patent Number: 4,585,336

[45] Date of Patent: Apr. 29, 1986

[54] AUTOMATIC DUPLEX ELECTROPHOTOGRAPHIC COPYING MACHINE

[75] Inventor: Toyoki Tanaka, Yamatokoriyama, Japan

[73] Assignee: Sharp Kabushiki Kaisha, Osaka, Japan

[21] Appl. No.: 612,571

[22] Filed: May 21, 1984

[30] Foreign Application Priority Data

May 30, 1983 [JP] Japan ..... 58-97299
Jun. 21, 1983 [JP] Japan ..... 58-113182

[51] Int. Cl.[4] ..... G03G 15/00

[52] U.S. Cl. ..... 355/3 SH; 355/23; 355/24

[58] Field of Search ..... 355/3 SH, 14 SH, 3 R, 355/14 R, 23, 24, 25; 271/279, 280, 301, 302, 303, 186

[56] References Cited

U.S. PATENT DOCUMENTS 4,173,410 11/1979 Tabata et al. ..... 355/24
4,191,465 3/1980 Boase et al. ..... 355/3 SH
4,272,180 6/1981 Satomi et al. ..... 355/3 SH
4,330,197 5/1982 Smith et al. ..... 355/14 SH
4,365,886 12/1982 Murakami et al. ..... 355/3 SH
4,487,506 12/1984 Repp et al. ..... 355/14 SH

*Primary Examiner*—A. C. Prescott
*Attorney, Agent, or Firm*—Birch, Stewart, Kolasch & Birch

[57] ABSTRACT

An automatic duplex electrophotographic copying machine comprises a paper supply device, a photoreceptor, a copy enabling device, a copied paper expelling device, a single-side copied paper storing device, and a selector activated for selecting the copied paper expelling device or the single-side copied paper storing device. The single-side copied paper storing device is movable to receive the single-side copy paper and supply it to the paper supply device, so that the single-side copied copy paper is transported to the photoreceptor and the copy enabling device, to copy a new image onto the other or reverse side of the paper. The selector comprises a flapper flapped for the selection. The single-side copied paper storing device comprises a paper regulating device for regulating the exact position of the paper within the device to copy the image on the exact position of the reverse side of the paper.

7 Claims, 8 Drawing Figures

AUTOMATIC DUPLEX ELECTROPHOTOGRAPHIC COPYING MACHINE

BACKGROUND OF THE INVENTION

The present invention relates to an electrophotographic copying machine and, more particularly, to an automatic duplex electrophotographic copying machine.

An electrophotographic copying machine produces on a photoreceptor an electrostatic latent image corresponding to an image on a document such as a manuscript or book to be copied. Toner particles are electrostatically adhered to the latent image, so that the latent image becomes visible as a toner image. The toner image on the photoreceptor is transferred onto a copy paper via a transference charger. The remaining toner particles and charges on the photorerceptor after the transfer are removed for the next copying operation.

There is present an improved electrophotographic copying machine of the type which can copy the images on two sheets of documents onto both sides of one or more copy papers, which is referred to herein as a "duplex copying machine". In such a machine, after a single side of the copy paper has been copied, the copy paper is turned over to transport it toward the toner image transfer portion, so that the next image is copied onto the other or reverse side of the single-side copied copy paper.

Conventionally, a complex assembly is needed to receive the single-side copied copy paper and forward it toward the toner image transfer portion, again. Therefore, it is desired to provide an improved automatic duplex copying machine.

SUMMARY OF THE INVENTION

Accordingly, it is an object of the present invention to provide an improved automatic duplex electrophotographic copying machine.

It is another object of the present invention to provide an improved automatic duplex electrophotographic copying machine for enabling duplex copying, successively and automatically.

It is a further object of the present invention to provide an improved automatic duplex electrophotographic copying machine equipped with a movable paper container for storing the single-side copy paper and transporting it to a paper input portion.

Briefly described, in accordance with the present invention, an automatic duplex electrophotographic copying machine comprises a photoreceptor, a paper supply device, a copy enabling device, a copied paper expelling device, a single-side copied paper storing device, a selector activated for selecting whether to operate the copied paper expelling device or the single-side copied paper storing device. The single-side copied paper storing device is movable to receive the single-side copied paper and supply it to the paper supply device, so that the single-side copy paper is transported to the photoreceptor and the copy enabling device, to copy a new image onto the other or reverse side of the paper. The selector comprises a set flapped for the selection. The single-side copied paper storing device comprises a paper regulating device for regulating the exact position of the paper with the desired device to copy the image on the exact position of the reverse side of the paper.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
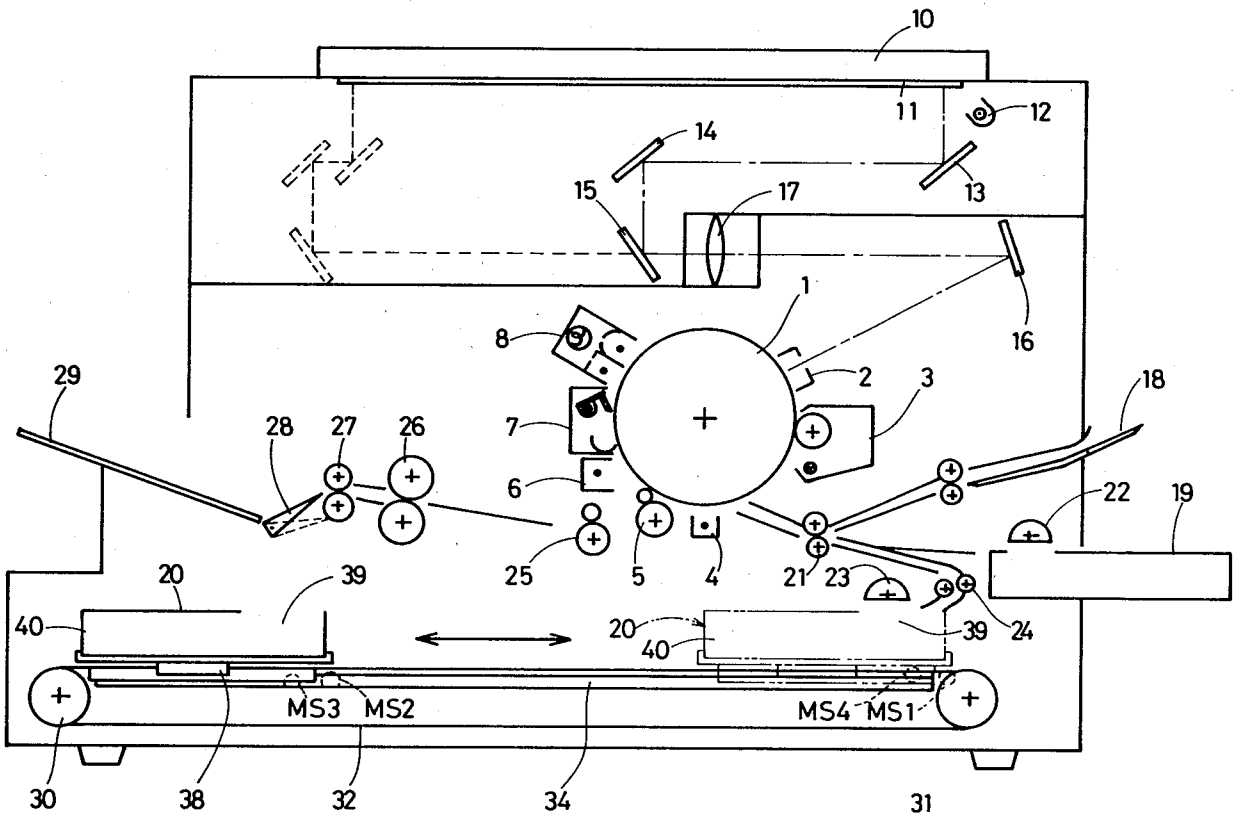
FIG. 1 is a sectional view, of an automatic duplex electrophotographic copying machine according to the present invention.

FIG. 1 is a side sectional view of an automatic duplex electrophotographic copying machine according to the present invention. As stated above, the word "duplex copy" is used to indicate that images are copied on both sides of one or more copy papers.

Referring to FIG. 1, a photoreceptor 1 is disposed around a rotational drum at the center of the copying machine, rotational in parallel with the base of the copying machine. Around the photoreceptor 1, there is provided a copy enabling means comprising a light exposure device 2, a developing device 3, a corona transfer device 4, a pair of separation rollers 5, a charge removing charger 6, a cleaning device 7, and a corona charger 8.

A document table 10 including a document transparent substrate 11 is provided for carrying a document to be copied thereon. An illumination lamp 12 is provided beneath the substrate 12 for emitting light beams toward the substrate 11. The reflected light beams from the document pass an optical system comprising mirrors 13–16 and a lens 17, so that the beams are incident upon and forcused on the photoreceptor 1 via the light exposure device 2. While receiving the reflected light beams from the document, the mirrors 13–15 are reciprocated under the substrate 11 between a predetermined distance depending on the size of the selected copy paper.

A paper introducing and meeting means is provided for introducing and meeting the copy paper with the photoreceptor 1, which comprises a manual insertion inlet 18, a paper cassette 19, a paper transport way from a movable paper storing cassette or container 20 to the corona transfer means comprising the corona transfer charger 4, and a pair of introduction rollers 21 for introducing the copy paper positioned at the respective transport ways to the corona transfer means. The paper introduction rollers 21 serve for a copy paper inserted through the manual insertion inlet 18, a copy paper stored within the paper cassette 19, and the single-side copied copy paper stored within the movable paper storing container 20, so that each copy paper is transported toward the photoreceptor 1 and the corona transfer charger 4 along respective transport way.

One or more paper pick-up semicircular rollers 22 are provided for picking up a single copy paper from the paper cassette 19. One or more paper pick-up semicilcular rollers 23 are provided for picking up the copied paper stored within the movable paper storing container 20, so that the picked-up paper is turn over by a pair of turnover rollers 24 to send it toward the introduction rollers 21.

The copy paper transported close to the photoreceptor 1 so as to transfer the toner image onto the paper by corona charging. The separation rollers 5 are operated to separate the paper from the photoreceptor 1. A pair of guide rollers 25 are provided for receiving and guiding the separated paper toward a pair of heat rollers 26. The pair of heat rollers 26 are operated to heat the copy paper carrying the toner image to fix the toner image onto the paper.

A paper receiving means is provided for receiving the fixed paper, which comprises a pair of paper guide rollers 27 and a flapper 28. The pair of paper guide rollers 27 are operated to guide the transferred paper toward an expelling plate 29 and the movable paper storing container 20 moving under the paper receiving means. The flap 28 is positioned adjacent the pair of paper guide rollers 27 for distributing the guided paper from the rollers 27 to either the expelling plate 29 or the movable paper storing container 20. The flapper 28 is flapped by a flapper solenoid FLS (not shown) for changing the guide of the copy paper toward either the plate 29 or the movable paper storing container 20.

According to the present invention, as stated above, the movable paper storing container 20 is positioned on the base of the copying machine. The container 20 can be reciprocated between a paper receiving position of receiving the single-side copied paper and a paper re-introduction position of introducing the single-side copied paper, again, to the copy enabling means.

Figure 2:
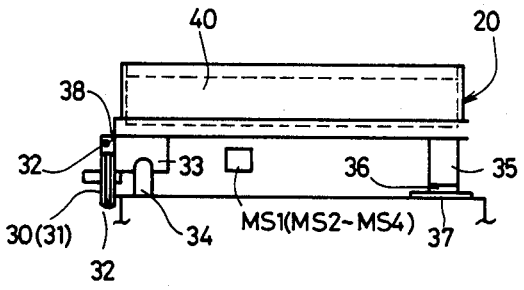
FIG. 2 is a front view of a movable paper container for storing and transporting the copy paper used in the copying machine of FIG. 1.

FIG. 2 shows a front view of the movable paper storing container 20. The storing container 20 comprises a paper storing portion 40, a coupling portion 33, and a leg 35 with a friction face 36 at the tip. The paper storing portion 40 is provided for receiving and storing the transported single-copy paper. At each of the sides of the storing container 20, the coupling portion 33 and the leg 35 are provided. The coupling portion 33 is formed for coupling with and sliding on a rail 34 secured on the base of the copying machine. The rail 34 is railed linearly and horizontally from the paper re-introduction means to the paper receiving means. A leg-slidable base plate 37 is provided on the base of the copying machine in parallel with the rail 34. The movable paper storing container 20 is maintained horizontally as the coupling portion 33 is coupled with the rail 34 and the friction plate 36 rests on the leg slidable base plate 37. Both the friction plate 36 and the leg-slidable base plate 37 are made of a material having a large friction coefficient. The moving of the movable paper storing container 20 is restricted between the friction plate 36 and the base plate 37. A pair of drive pulleys 30 and 31 are separated substantially identical with the length of the rail 34. Across the pair of drive pulleys 30 and 31, a drive wire 32 is extended in parallel with the rail 34. A connection portion 38 of the paper storing container 20 is connected with the drive wire 32.

The pair of drive pulleys 30 and 31 are rotated by a cassette feed motor (CFM) or a cassette rerun motor (both not shown). The drive wire enables the paper storing container 20 to move horizontally. According to the driving of the cassette feed motor (CFM), the movable paper storing container 20 is moved from the paper receiving position of receiving the single-side copied paper to the paper re-introduction position of introduicing the single-side copied paper. At the paper receiving position, a paper pick-up opening 39 of the paper container 40 faces a paper output way for the guide rollers 27. At the paper re-introduction position, the paper pick-up opening 39 faces the paper pick-up rollers 23. According to the drive of the cassette return motor (CFM), the movable paper storing container 20 is moved from the paper re-introduction position to the paper receiving position.

Two switches MS1 and MS2 are provided for sensing when the container 20 reaches the paper receiving position or the paper re-introduction position. Other switches MS3 and MS4 are provided for sensing when, at the respective positions, the container 20 accomodates the single-side copy paper. Each of the switches MS4 and MS3 are positioned adjacent each of the switches MS1 and MS2.

Figure 3:
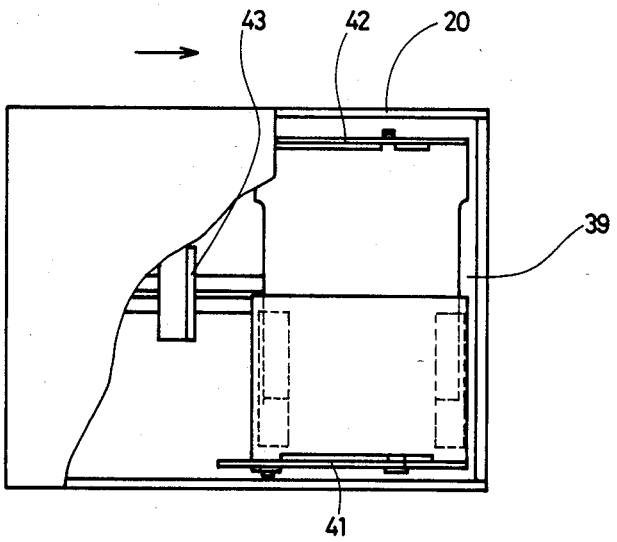
FIG. 3 is a plan view of the container of FIG. 2, showing the inner structure thereof.

FIG. 3 shows a paper regulating plates of the paper storing container 20. The regulating plate is provided for regulating both rectangular side edges and the rear edge (the front edge of the paper when next copied and transported in the next paper travel direction) of the copied paper depending upon the size of the paper. A pair of side plates 41 and 42 are movably provided within the paper storing container 20 for regulating the rectangular edges of the paper. A fear regulating plate 43 is movably provided for regulating the rear edge of the transported paper. These plates 41, 42 and 43 are movably secured at the bottom of the container 20.

Figure 4:
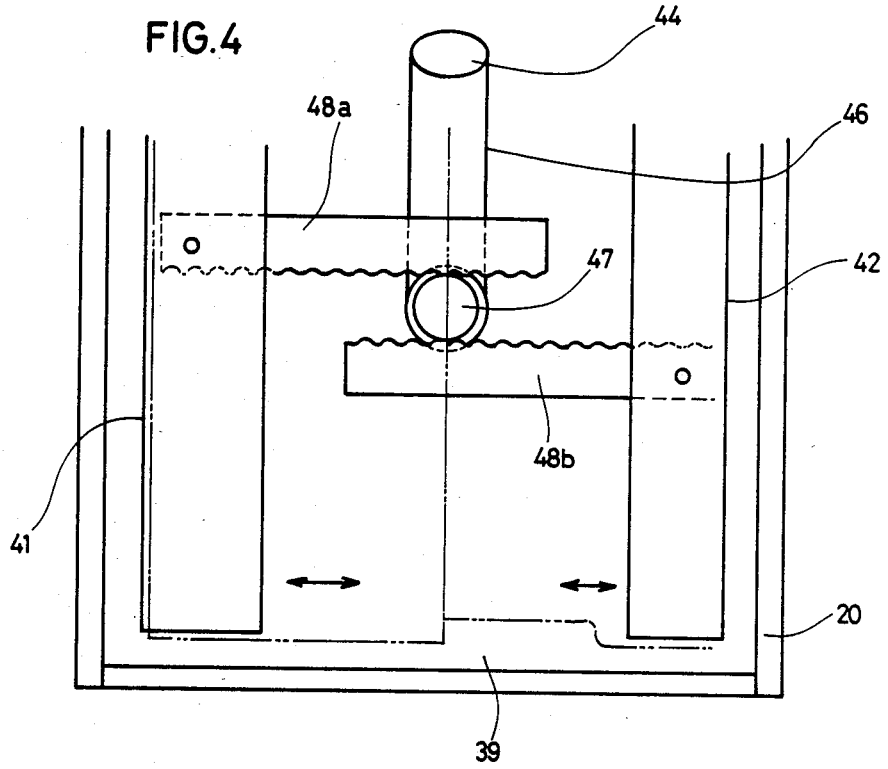
FIG. 4 is a plan view of a portion of the container of FIG. 2, showing a drive mechanism for side regulating plates in the container.

As shown in FIG. 4, a driving motor M1 (44) is provided for automatically adjust the moving of the side plates 41 and 42 in conformance with the width of the paper. A pinion 47 is rotated with a belt 46. To the pinion 47, a pair of racks 48*a* and 48*b*, respectively, coupled to the side plates 41 and 42. The rotation of the pinion 47 enables the racks 48*a* and 48*b* to be shifted along the direction as denoted with arrows.

Figure 5:
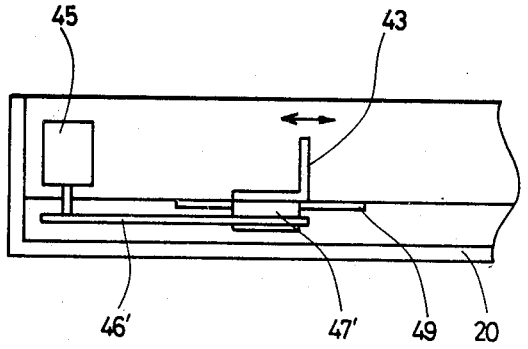
FIG. 5 is a sectional view of a portion of the container of FIG. 2, showing another drive mechanism for a rear regulating plate of the container.

As FIG. 5 shows, another driving motor M2 (45) is provided for rotating a pinion 47' via a belt 46', so that the rear regulating plate 43 which is coupled to a rack 49 gearing with the pinion 47' is adjusted in conformance with the length of the paper.

The motors 44 and 45 are activated depending upon the size of the copy paper used for the copying machine. The plates 41, 42 and 43 are shifted to correspond to the size of the copy paper. Preferably, the driving motors 44 and 45 are a pulse motor, so that pulses corresponding to the size of the copy paper are supplied to the motors 44 and 45 to shift the plates 41, 42, and 43. The initial positions of these plates are selected to be able to accomodate and regulate a maximun-size copy paper to be selected. From this initial position, they are moved to correspond to the selected copy paper size by supplying the selected pulses to the motors.

By way of example, the copy paper size is detected by attaching the paper cassette 19 to the copying machine. Normally, the paper cassette 19 has a number of selected size copy papers. A size information means specific to one paper cassette 19 is provided at the front page of the cassette 19. The copy paper size can be detected by reading the size information means when attached. This is not limitative and it may be possible that a detection means is provided for detecting the width or the length of the used copy paper. Such a size detection means may be provided at the copy paper introduction position of the copying machine.

Although not shown in the drawings, a copy control panel is provided on the copying machine for instructing the copying operation. The control panel comprises a copy start switch PSW and a duplex copy selection switch 2CSW. The duplex copy selection switch 2CSW is operated to set the duplex mode into a duplex mode memory FF1 provided in a control memory, e.g., a RAM. Upon receipt of power supply, a ready lamp RL in the control panel is illuminated for showing that a copy instruction is now possible. When the lamp RL is illuminated, a two-minute timer 120T starts. When the copy instruction switch PSW is not activated and the ready lamp RL is illuminated, the duplex copy mode is terminated and released.

Figure 6:
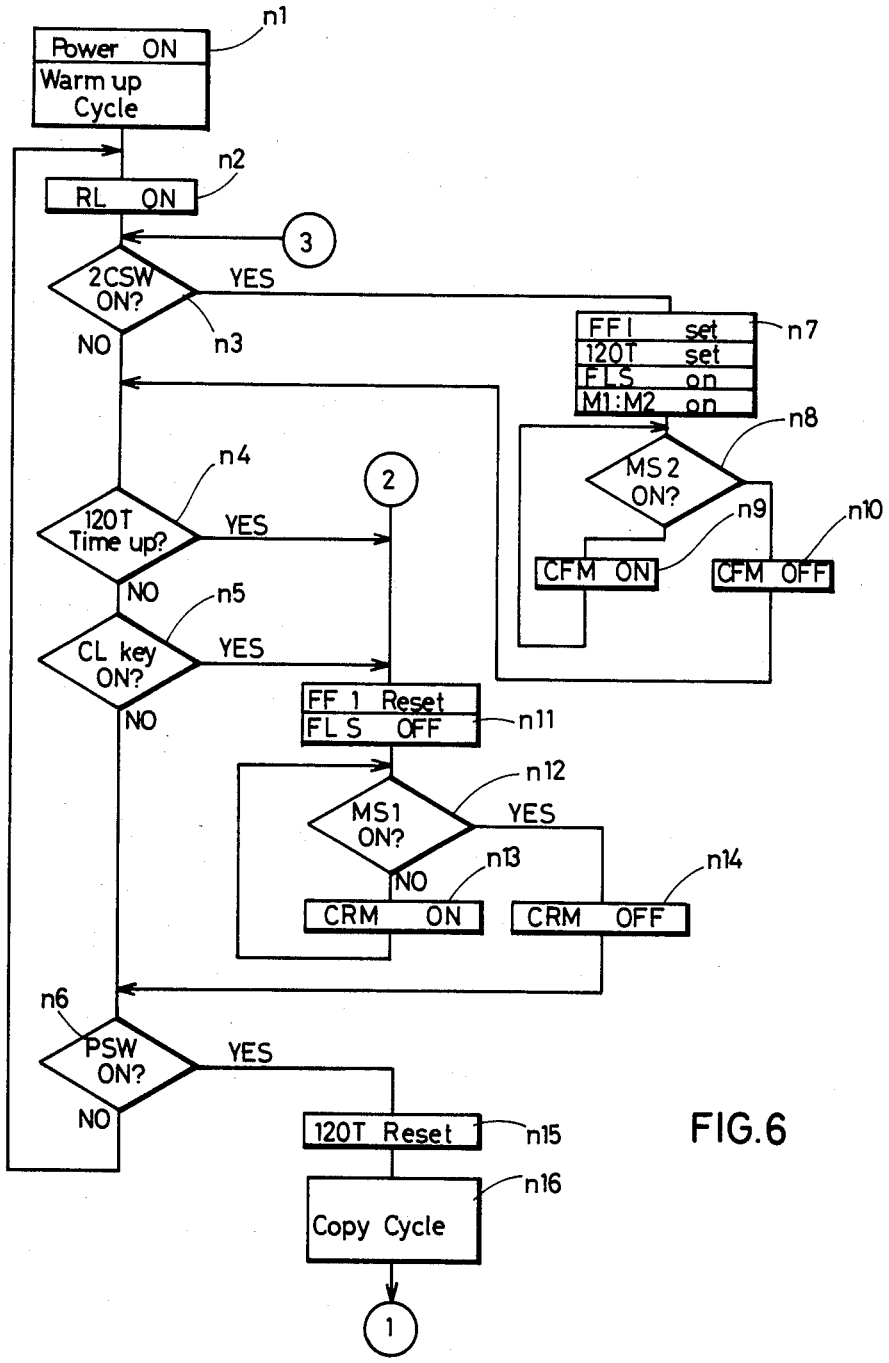
FIGS. 6 and 7 are flow charts of the duplex copying operation according to the present invention.
Figure 7:
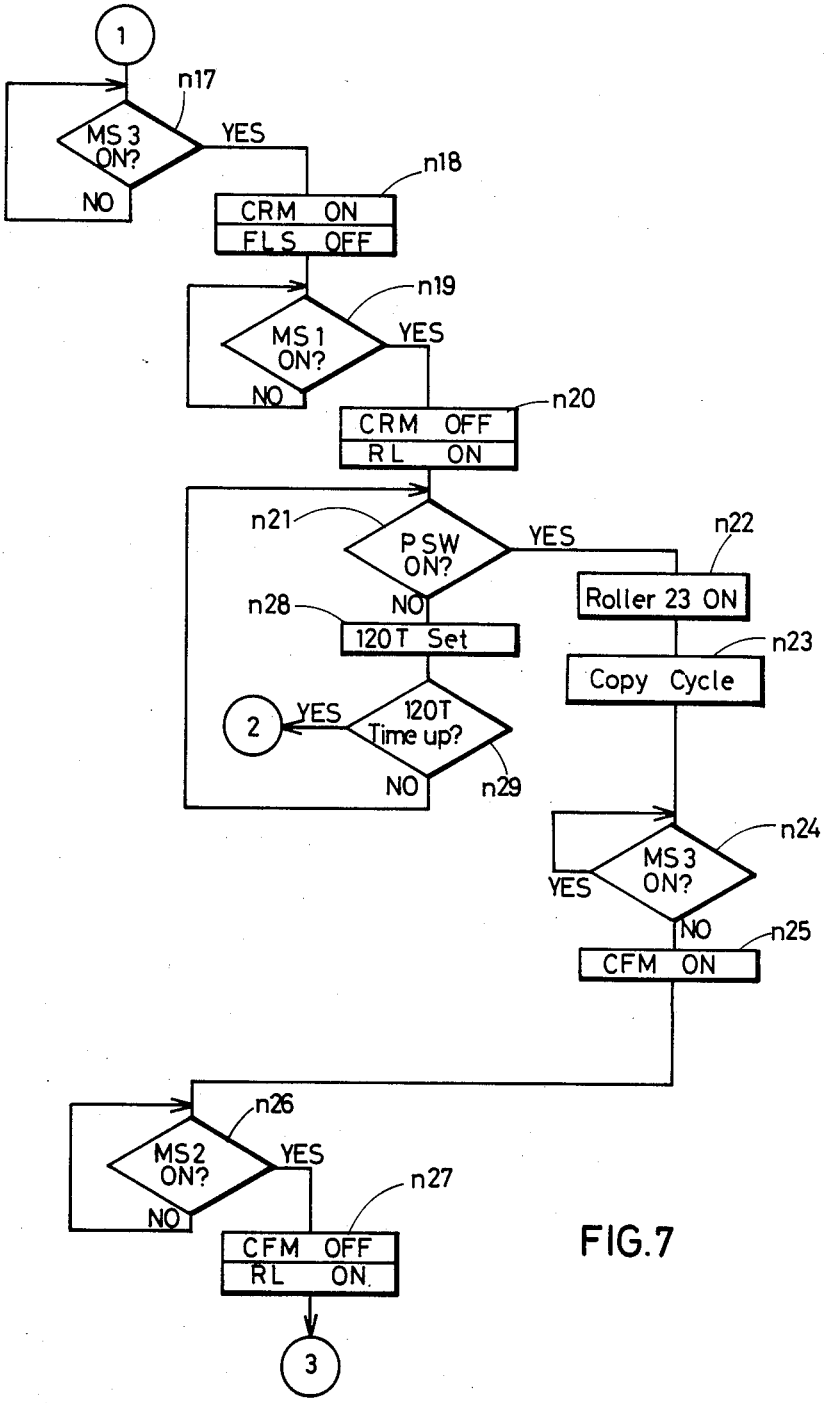

FIGS. 6 and 7 are flow charts of the duplex copying operation according to the present invention.

Step n1: The power supply is enabled.

Step n2: A warm up cycle is operated and the ready lamp RL is illuminated.

Step n3: The duplex copy instruction switch 2CSW is activated.

Step n7: The duplex copy mode is set in the duplex copy mode memory FF1 while the two minute timer 120T starts. Upon setting the duplex copy mode, the flapper solenoid FLS is activated to flap and position the flapper 28 as shown in the solid line of FIG. 1, so that the paper outputted from the guide rollers 27 is forwarded toward the movable paper storing container 20. The motors 44 and 45 are rotated, so that the regulating plates 41, 42, and 43 are moved and positioned as corresponding to the copy paper size. For this purpose, the pulses which correspond to the copy paper size and are developed by the size detection means are applied to the motors 44 and 45 to shift the plates 41, 42, and 43.

Step n8: It is detected whether the switch MS2 is conductive or not.

Step n9: When the switch M2 is nonconductive, the cassette feed motor CFM is activated, so that the movable paper storing container 20 is moved to the paper receiving position for receiving the single-side copied paper, at which the switch MS2 becomes conductive. After the storing container 20 is moved toward the paper receiving position, the cassette feed motor (CRM) is stopped to select following steps n10–n4.

Steps n4–n6: It is detected whether, within 120 seconds from the activation of the duplex copy switch 2CSW, the copy switch PSW is activated without the activation of the clear key CL. If so, steps n15 and the following steps are selected to execute the copying operation.

Steps n11–n14: These steps and, finally, step n6 are selected if the clear key CL is activated or otherwise the copy switch PSW is not activated after the lapse of the 120 seconds after the duplex copy switch 2CSW is activated.

More specifically, in step n11, the duplex copy mode memory FL1 is reset and the flapper solenoid FLS becomes nonconductive, so that the flapper 28 is flapped and positioned as shown by the dotted line of FIG. 1 to thereby direct the output way from the guide rollers 27 toward the movable paper storing container 20.

In steps n12–n14, the container 20 is moved by the driving of the cassette return motor (CRM) at the paper re-introduction position for introducing the copied paper into the photoreceptor 1, again, at which the switch MS1 becomes nonconductive.

Steps n15 and n16: In response to the first actuation of the copy switch PSW in the duplex copy mode, the two-minute timer 120T is reset and the single-side copying operation is conducted. In step n16, a toner image corresponding to the image on the document is formed on the photoreceptor 1 with the processes of the charging, the light exposure, and the developing. The corona transfer of the toner image onto the copy paper enables the copying operation. The paper has been transported from the introduction rollers 21 via the manual insertion inlet 18 or the paper cassette 19. The separation rollers 5 are activated to separate the copied paper from the photoreceptor 1. The copied paper is transported to the movable paper storing container 20 via the receiving rollers 25, the heat rollers 26, and the guide rollers 27. The single-side copy paper is stored within the container 20 while the edges of the copied paper are regulated by the regulating plates 41 to 43 of the container 20.

Step n17: The switch MS3 is operated to detect whether one or more single-side copied papers (the number of copy papers can be selected) have been stored within the container 20.

Step n18: Upon the detection by the switch MS3 in step n17, the cassette return motor (CRM) is activated. At the same time, the driving of the solenoid FLS is stopped so that the flapper 28 is flapped and positioned as shown by the dotted line of FIG. 1 to thereby change the output way from the guide rollers 27 toward either the container 20 or the expelling plate 29.

Steps n19 and n20: The cassette return motor (CRM) is activated until the switch MS1 becomes conductive, so that the movable paper storing container 20 is moved and positioned at the paper re-introducing position for introducting the single-side copied paper, again. After the container 20 is positioned at the paper re-intorduction position, the driving of the cassette return motor (CRM) is stopped and the ready lamp RL is illuminated to indicate that the next copying operation is now possible. The reason why the container 20 accomodating the single-side copied paper is moved from the paper receiving position to the paper re-introduction position is to copy on the other side of the copied paper.

Step n21: A new document is placed on the table 10, so that the copy switch PSW is activated to instruct and copy the new image on the other side of the paper.

Steps n22 and n23: Upon the the second actuation of the copy switch PSW in the duplex copy mode, the pick-up rolers 23 are rotated and execute the copying operation similar to the operation in step n16. The single-side copied paper is picked up by the pick-up rollers 23 from the container 20. The pick-up paper is turn over by the turnover rollers 24. The introduction rollers 21 are activated to transport the paper toward the corona transfer portion. The paper transported close to the photoreceptor 1 receives the new toner image onto the other or reverse surface opposite to the previously copied surface. The copied paper is transported with the separation rollers 5, the guide rollers 25, and the heat rollers 26 toward the paper receiving portion. The guide rollers 27 and the flapper 28 are operated to exhaust the copied paper onto the expelling plate 29 along the way to it. When the copying cycle of step n23 has been completed, the rotation of the paper pick-up rollers 23 is stopped.

Step n24: It is detected whether the switch MS3 is made conductive after the duplex copying operation has been terminated.

Steps n25 and n26: The cassette feed motor (CFM) is operated until the switch MS2 becomes conductive, so that the container 20 is moved and positioned at the paper receiving position for receiving the single-side copy paper.

Step n27: After the movement in the above step, the cassette feed motor CFM is stopped and the ready lamp RL is illuminated to indicate that the next copying operation is now possible. Step n3 is re-selected.

In step n21, the two-minute timer 120T is used to count the time when the second activation of the copy switch PSW is not present. If, in steps n28 and n29, the copy switch PSW is not activated within 120 seconds during the illumination of the ready lamp RL, the steps following step n11 are selected to thereby release the duplex copy mode. When the duplex copy mode is not selected and the single-side copied mode is selected, instead, the movable paper storing container 20 is prevented from moving, so that the copy switch PSW is operated to carry out the copying operation. It may be possible that the duplex copying mode is automatically released to automatically select the single-side copy mode if the duplex copy mode has been selected but a predetermined time has been elapsed in this mode.

Figure 8:
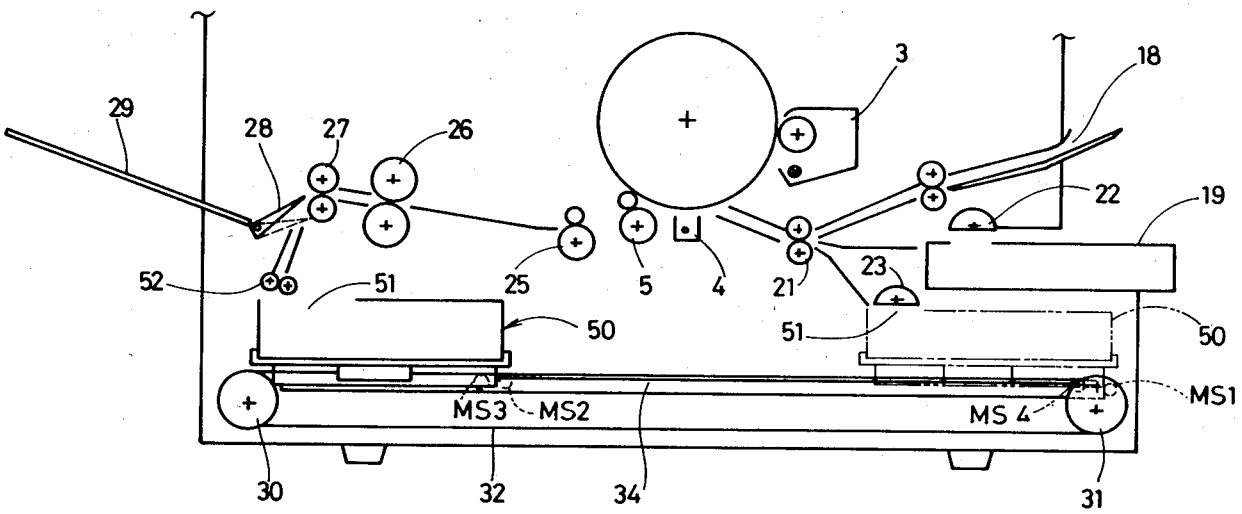
FIG. 8 is a sectional view of another automatic duplex electrophotographic copying machine including another form of the movable paper container according to another preferred form of the present invention.

FIG. 8 shows another copy machine according to another preferred embodiment of the present invention. Like elements of those of FIG. 1 are indicated by like numerals. In the above-described preferred embodiment of FIG. 1, the turnover rollers 24 for turning over the single-side copy paper is positioned adjacent the paper introduction position including the pick-up roller 23. In FIG. 8, a pair of turnover rollers 52 are positioned adjacent the paper receiving position. Since the turnover rollers 52 are positioned at this portion, the paper inlet/outlet opening 51 of another paper storing plate 50 is positioned adjacent the side of the copying machine near the paper expelling plate 29, and the extrusion portions of the copying machine of FIG. 1 can be eliminated, so that the copying machine becomes compacter.

As described above, according to the present invention, the set 28 is flapped for selecting the output way of the copied paper. It is directed toward the movable paper storing container 20, so that it can store the paper. The container 20 is moved toward the paper re-introduction position, so that the single-side copied paper can be transported into the paper introduction means. Since it is simple that the plate 20 is horizontally moved along the base of the copying machine and it is unnecessary to provide any return route for returning the single-side copied paper toward the copy paper introduction means, the copied paper is prevented from being jammed during the return travel, so that a compact and stable copying machine can be achieved. A successive copying operation becomes possible because the flapper 28 is set for subsequently selecting either the single-side copied paper or the duplex copied copy paper to finally exhaust the paper onto the expelling plate 29, and the movable paper storing container 20 can store the one or more single-side copied papers. Since the papers as stored within the paper container 20 are regulated according to the paper sizes, it can be expected that the image can be copied at the exact position of the copy papers. Further, because the single paper cassette 19 is commonly used to supply copy paper for both the single-side copy mode and the duplex copy mode, it is unnecessary to exchange the paper cassette depending upon the selected copy mode, so that the copying operation becomes simpler and speedier.

While only certain embodiments of the present invention have been described, it will be apparent to those skilled in the art that various changes and modifications may be made therein without departing from the spirit and scope of the present invention as claimed.

What is claimed is:

1. An automatic duplex electrophotographic copying machine comprising:

photoreceptor means for forming an image thereon;

paper supply means for forming an image thereon;

paper supply means for supplying a copy paper toward said photoreceptor means;

copy enabling means inclusive of a light exposure means, developing means, and image transfer means for copying the image onto said copy paper;

paper expelling means for receipt of said imaged copy paper outside said copying machine;

paper storing and returning means adapted to be reciprocated horizontally between a first paper receiving position for receiving and storing said single-side copied paper and returning it to a second paper re-introduction position for introducing said single-side copied paper to said paper supply means;

means for moving said paper storing and returning means between said first position of receiving said singl-side copied paper and said second paper re-introduction position; and selection means for selecting whether to direct said copied paper to said expelling means or to said paper storing means.

2. The copying machine of claim 1, wherein said selection means comprises a flapper element.

3. The copying machine of claim 1, further comprising a paper regulating means for regulating the positioning of the copied paper within said storing and returning means.

4. The copying machine of claim 1, wherein said paper storing and returning means is positioned at a base of said copying machine.

5. The copying machine of claim 1, further comprising turnover means for turning over said copied copy paper positioned at said paper supply means.

6. The copying machine of claim 5, wherein said turnover means is juxtapositioned to said selection means.

7. The copying machine of claim 1, further comprising motor means for reciprocating said storing and returning means.

* * * * *